US005524459A

United States Patent [19]

Beconcini

[11] Patent Number: 5,524,459

[45] Date of Patent: Jun. 11, 1996

[54] DEVICE FOR POSITIONING THREAD GUIDES IN SELECTABLE POINTS IN A CIRCULAR KNITTING MACHINE

[75] Inventor: Paolo Beconcini, Florence, Italy

[73] Assignee: Matec S.r.l., Scandicci, Italy

[21] Appl. No.: 426,757

[22] Filed: Apr. 21, 1995

[30] Foreign Application Priority Data

May 16, 1994 [IT] Italy ..... BO94A0218

[51] Int. Cl.[6] ..... D04B 15/38; D04B 15/58

[52] U.S. Cl. ..... 66/136; 66/125 R; 66/14

[58] Field of Search ..... 66/125 R, 136, 66/141, 14

[56] References Cited

U.S. PATENT DOCUMENTS 2,304,916 12/1942 Hilker et al. ..... 66/136 X 2,425,243 8/1947 Holmes et al. ..... 66/136

2,959,040 11/1960 Saunders ..... 66/14

4,502,299 3/1985 Keel et al. ..... 66/136 X

*Primary Examiner*—John J. Calvert

*Attorney, Agent, or Firm*—Guido Modiano; Albert Josif

[57] ABSTRACT

A device for positioning thread guides in selectable points in a circular knitting machine, which has a unit for moving the thread guide closer or further away from the cylinder. The unit is a rod-and-crank system in which an intermediate region of the rod is slides guided with respect to a fixed slider. The end of the rod that supports the thread guide is adapted to move, as the crank is actuated, along a curved path from a spaced inactive position to an advanced thread delivery position. The unit is provided with elements for articulation to a fixed frame along an axis that is substantially parallel to the axis of the crank. An elastic return spring and an angular spacing piston are arranged between the unit and the frame and can be actuated selectively to move the thread position to different locations.

4 Claims, 4 Drawing Sheets

DEVICE FOR POSITIONING THREAD GUIDES IN SELECTABLE POINTS IN A CIRCULAR KNITTING MACHINE

BACKGROUND OF THE INVENTION

The present invention relates to a circular knitting machine and particularly to the feeding of thread to said machine to manufacture tubular knitted items such as socks or stockings, and relates to a device for positioning the feed threads at the needle holders of the active needles of a double-cylinder machine.

Double-cylinder circular knitting machines generally essentially comprise two coaxial rotating cylinders which are both provided, at their outer cylindrical surface, with respective multiple longitudinal slots.

Respective needles are guided in the slots and form the loop of knitting during their vertical stroke by cooperating with the sinkers.

The slots of the cylinders are equal in number to the needles that slide within them with a reciprocating vertical motion and are swapped between the two cylinders: in order to manufacture stockings in general there may be up to approximately 400 slots per cylinder, whereas for the manufacture of men's socks the number of needles is generally between 84 and 280.

The needles are fed, in their reciprocating vertical motion, in fixed angular positions and at the most protruding levels of their strokes with respect to the cylinder on which they are located, by feeder stations which provide, each time, the needles with the feed thread that must be knit in the portion of knitting being formed, in that specific row of knitting and in that specific angular position: every time the feed changes, it is necessary to replace the previously fed thread with the thread that constitutes the new feed.

Each feed thread is carried by a thread guide which takes the thread from a spool: the various thread guides are arranged at mutually different levels and/or radial distances so that their paths do not interfere and so that a thread guide can move its thread to knit without preventing another thread guide from removing its thread from knitting.

In thread guide actuation devices, which often comprise crank-and-rod systems, the end of the thread guide usually follows a specific, usually curved, path which is always the same to move it from an inactive position A to a position B in which it places the thread close to the cylinder and vice versa: in conventional devices there is the drawback that each thread guide can position its thread only in a preset position of the path of the needles, thereby causing a certain stiffness in textile production.

In order to achieve greater freedom in knitting and higher reliability, it would instead be useful to be able to vary, within a certain range, for example 10–20 needle pitches, the point where the new thread is positioned: this possibility becomes very important, with particular reference to the production of sports socks, for feeding the elastic thread and for the initial thread for each new sock.

In particular, with respect to the usual path that moves the end of the thread guide from a retracted inactive position A to the advanced position B for positioning the thread proximate to the cylinder, in order to feed the initial thread of the tube of knitting the end of the thread guide must move to an even further advanced position C and then move to the conventional advanced position B and subsequently follow the usual path: in order to feed the elastic thread, the thread guide must instead first position the thread in B and then move to a position D that is retracted with respect to B.

Currently used devices that meet this requirement are, in some solutions (in which the entire thread guide assembly moves parallel to itself), particularly bulky, whereas other solutions that act on the movable end arm of the thread guide have been found to be subject to jamming and malfunctions.

SUMMARY OF THE INVENTION

The principal aim of the present invention is to obviate the above mentioned drawbacks of known devices, that is to say, to provide a device for positioning thread guides in a circular knitting machine in selectable points that are further advanced or further retracted with respect to the conventional position according to the requirements, which is highly compact, reliable, and not subject to jamming.

Within the scope of this aim, an object of the present invention is to provide a structure that is simple, relatively easy to obtain in practice, safe in use, effective in operation, and relatively inexpensive.

This aim and this object are both achieved by the present device for positioning thread guides in selectable points in a circular knitting machine, which comprises a unit for moving the thread guide closer or further away, said unit being constituted by a rod-and-crank system in which an intermediate region of the rod is guided so that it can slide with respect to a fixed slider and the end of the rod that supports the thread guide is adapted to move, when the crank is actuated, along a curved path from a spaced inactive position to an advanced thread delivery position, said device being characterized in that said unit is provided with elements for articulation to a fixed frame along an axis that is substantially parallel to the axis of the crank and in that elastic return means and angular spacing means are arranged between said unit and said frame and can be actuated selectively to move the point where the lo thread is positioned to different locations.

BRIEF DESCRIPTION OF THE DRAWINGS

Further features will become apparent and evident from the detailed description of a preferred but not exclusive embodiment of a device for positioning thread guides in selectable points in a circular knitting machine, according to the invention, illustrated only by way of non-limitative example in the accompanying drawings, wherein.

DESCRIPTION OF THE PREFERRED EMBODIMENTS

Figure 1:
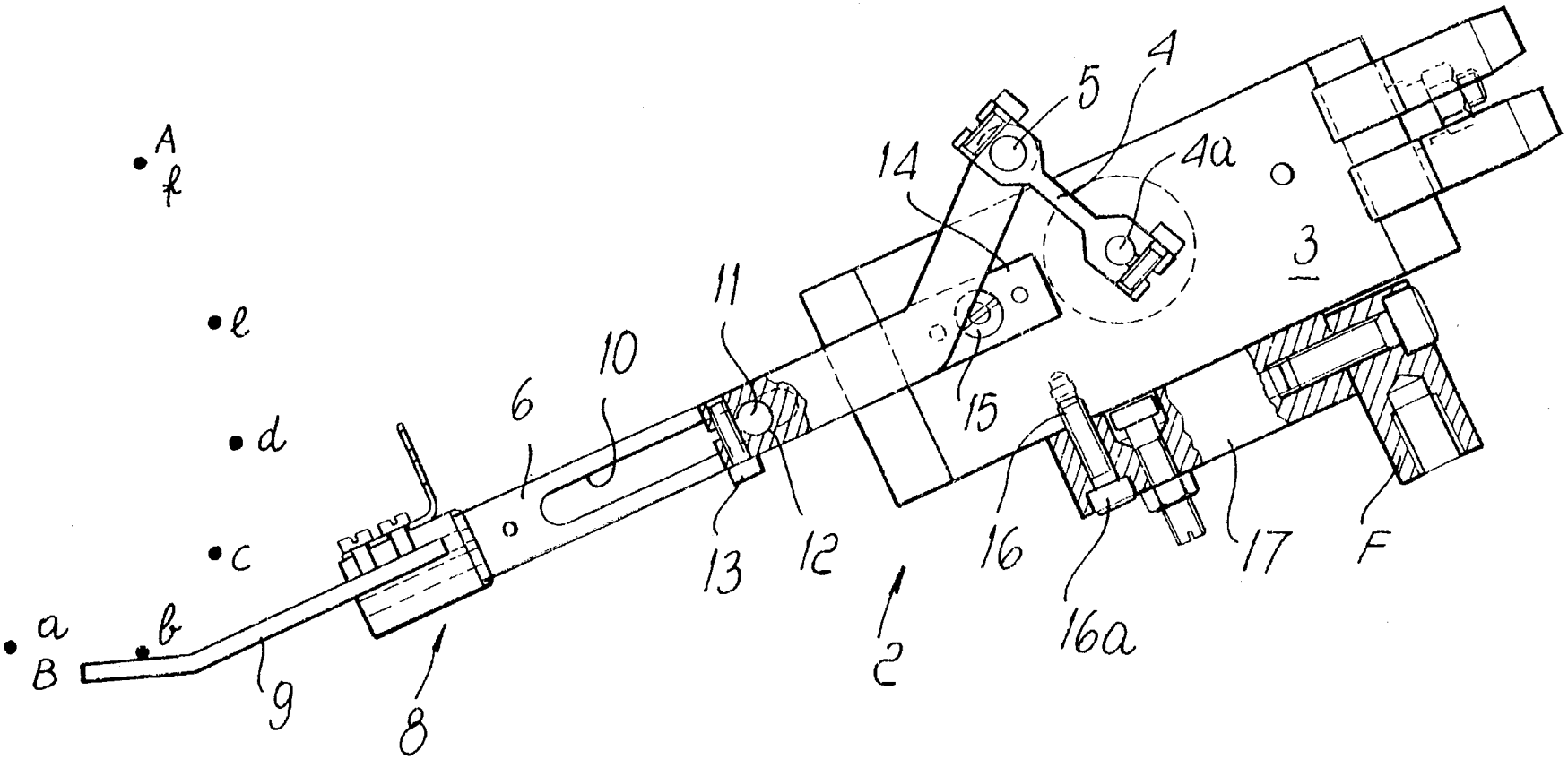
FIG. 1 is a partially sectional top view of a device for positioning thread guides in a circular knitting machine.

With particular reference to the above figures, the reference numeral 1 generally designates a device for positioning thread guides in selectable points in a circular knitting machine, according to the invention.

The device 1 comprises a conventional unit 2 for moving the thread guide closer and further away which is constituted by a plate-like support 3 in which a pivot 4*a* is rotatably mounted; one end of a crank 4 is fixed to said pivot, and said crank has, at its other end, a pivot 5 to which one end of a rod 6 is articulated; said rod 6 forms an obtuse angle 7 and has, at its other end, grip clamps 8 for a thread guide 9; in an intermediate region, said rod 6 has a longitudinal slot 10 which is slideably guided with respect to a fixed slider constituted by a button 11 that can slide within the slot 10 and is fixed, by means of a coupling provided by a split hole 12 and a locking bolt 13, to the end of an arm 14 which is rigidly coupled by tightening the screw 15 to the support 3 in an angularly adjustable position: by varying the length of the arm 14 and its angular position with respect to the support 3 it is possible to vary the path followed by the thread guide when the crank 4 is actuated.

In the various figures, the symbols a, b, c, d, e, and f reference the positions normally assumed by the thread guide and a', b', c', d', e', f' reference the selectable positions: it is clearly shown that the paths are different according to the length and position of the arm 14.

When the crank 4 is actuated, the thread guide is adapted to follow a curved path from a spaced inactive position A to an advanced thread delivery position B.

The support 3 has, along its edge, a threaded hole 16 for screwing at least one bolt 16*a* for fixing it for example to a supporting bracket 17 which can be coupled directly to a fixed anchoring point F if the possibility of selecting the positioning point of the thread guide is not required.

When the positioning point must be selectable, a bolt 16*a* can be screwed in the hole 16: said bolt 16*a* fixes an L-shaped element 18 to which a frame 20 is articulated, by means of a bolt-and-nut assembly 19, along an axis that is substantially parallel to the axis of the crank 4: the frame 20 can be rigidly coupled by means of a bolt 32 to the fixed anchoring point F; a threaded pin 21 is rigidly coupled to the support 3 and a threaded pin 22 is rigidly coupled to the frame 20, and a helical traction spring 23 is stretched between said pins and is suitable to keep the support 3 and the frame 20 under traction against each other.

Two parallel threaded holes are formed edgeways in the frame 20 at the two sides of the bolt 19, and two bolts 24 and 25 can be screwed therein; said bolts adjust the stroke Limit for the movement of the support 3 towards and respectively away from the frame 20; respective locking nuts 26 are screwed on the bolts 24 and 25.

The cylindrical seat 27 for the hermetic sliding of a piston 28 is formed edgeways in a median position of the frame 20; said piston 28 is meant to produce the angular spacing of the support 3 from the frame 20; the seat 27 is connected to a duct 29 for feeding pressurized air or oil, and the piston 28 is extended by an axial stem 30 on which an annular sealing gasket 31 is centered.

Figure 2:
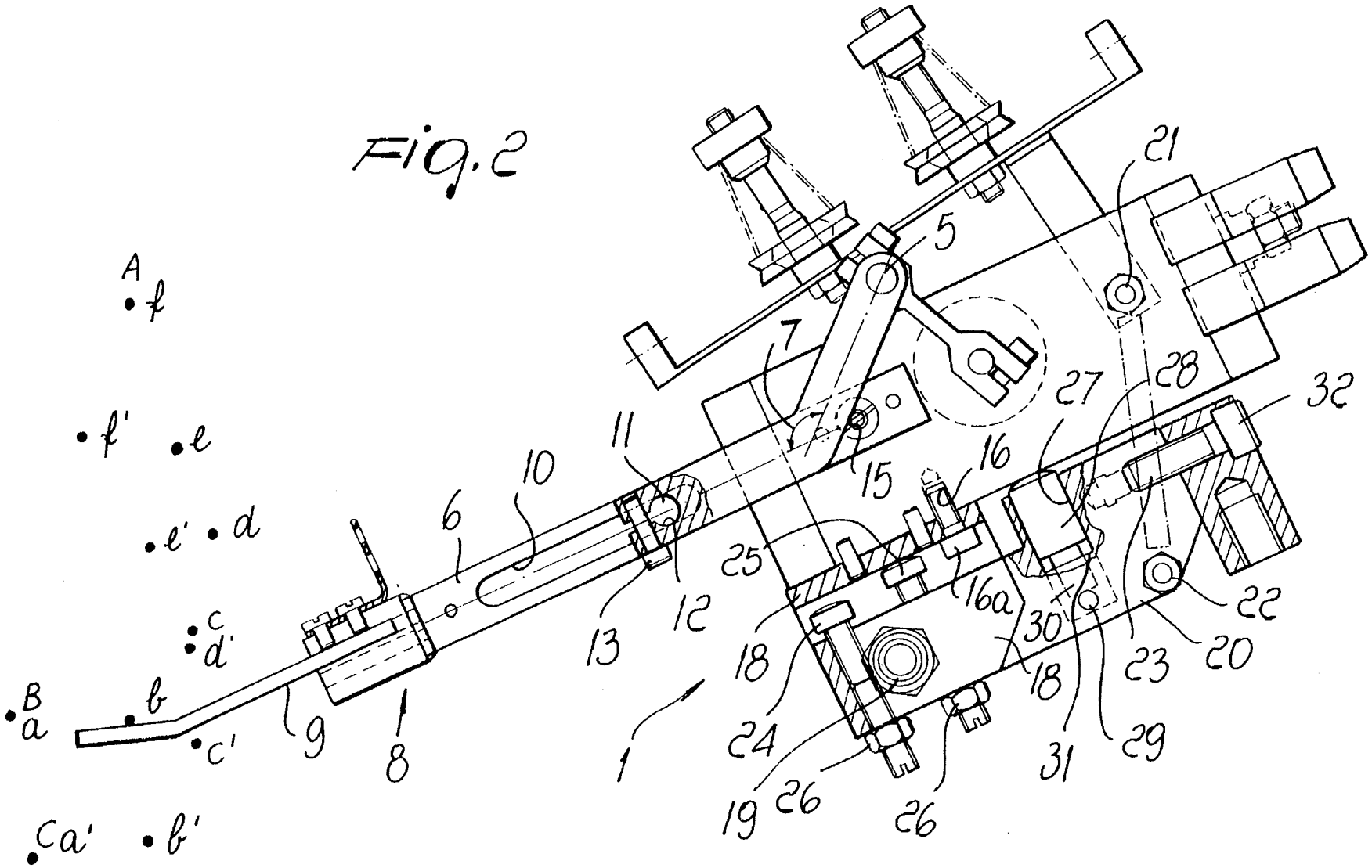
FIG. 2 is a partially sectional top view of a device for positioning thread guides in selectable points in a circular knitting machine.
Figure 3:
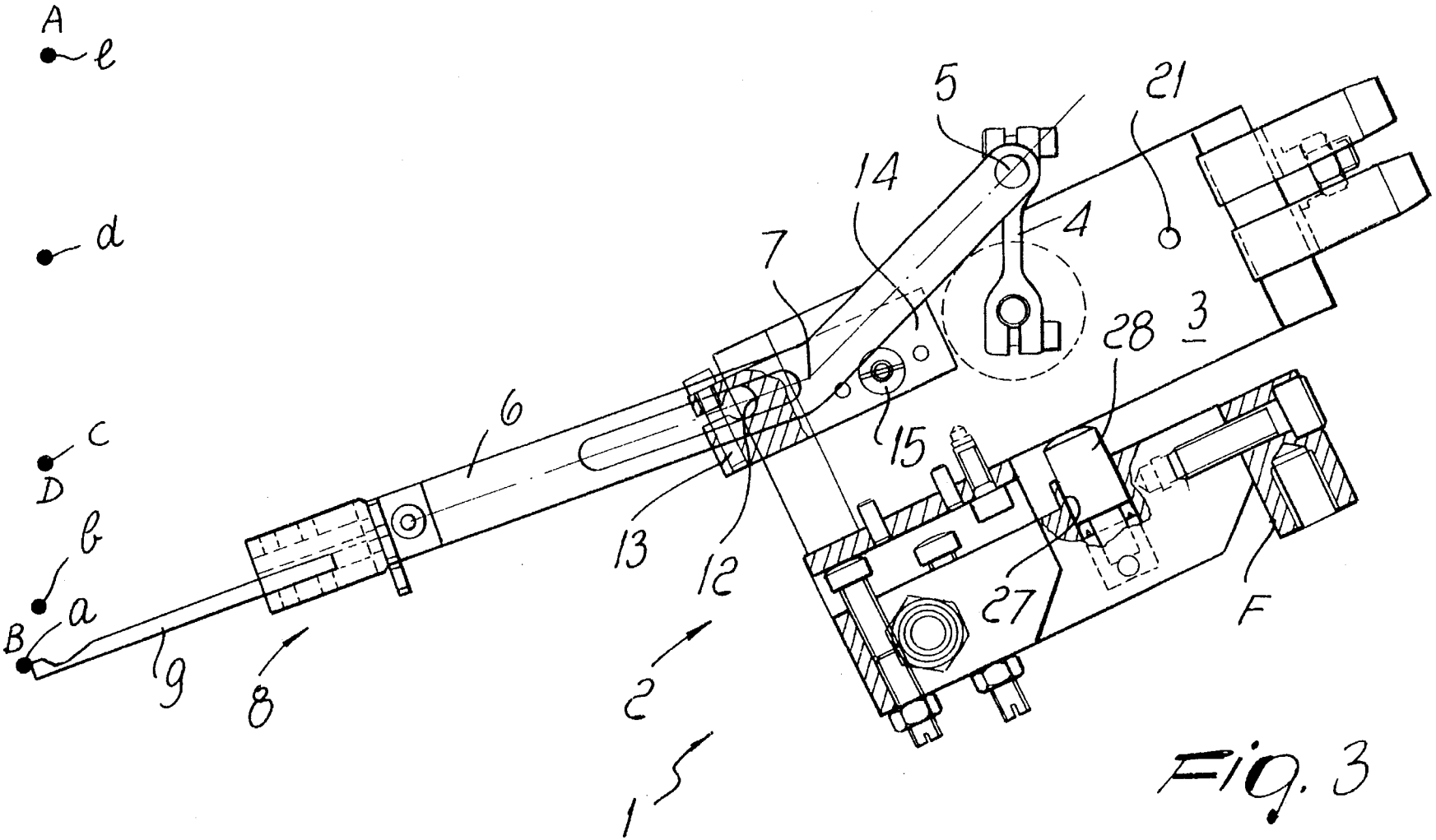
FIG. 3 is a partially sectional top view of another embodiment of the device of FIG. 2.
Figure 4:
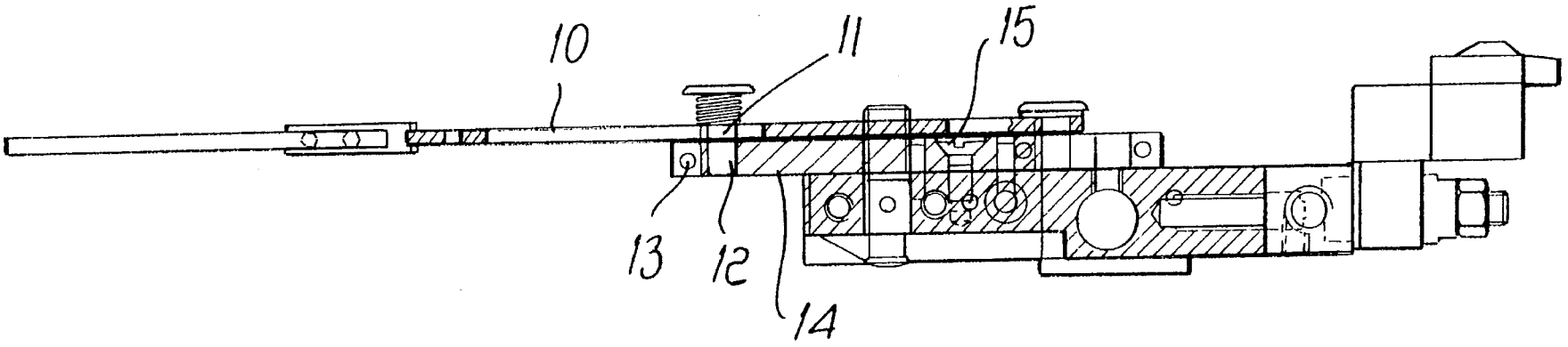
FIG. 4 is a sectional front view of a device for positioning thread guides in selectable points in a circular knitting machine.

FIG. 2 illustrates a device in which by supplying pressure to 27 the piston 28 selects the thread guide so that it moves into an advanced position C with respect to the position B which it reaches when the piston is inactive; FIG. 3 instead illustrates a device for which by removing pressure from 27 the piston 28 selects the thread guide so that it moves into a position D which is retracted with respect to the position B that it reaches when the piston is inactive.

It has thus been shown that the invention achieves the intended aim and object.

The invention thus conceived is susceptible of numerous modifications and variations, all of which are within the scope of the inventive concept.

All the details may furthermore be replaced with other technically equivalent ones.

In practice, the materials employed, as well as the shapes and dimensions, may be any according to the requirements without thereby abandoning the scope of the protection of the claims that follow.

What is claimed is:

1. Device for positioning thread guides in selectable points in a circular knitting machine, comprising a unit for moving the thread guide closer and further away, said unit being constituted by a rod-and-crank system having a rod and a crank, an intermediate region of the rod being guided for sliding with respect to a fixed slider and an end of said rod that supports the thread guide is movable, when the crank is actuated, along a curved path from a spaced inactive position to an advanced thread delivery position, wherein said unit is provided with elements for articulation to a fixed frame along an axis that is substantially parallel to an axis of the crank, and elastic return means and angular spacing means are arranged between said unit and said frame, said spacing means being actuatable selectively to move a point where a thread is positioned to different locations.

2. Device according to claim 1, wherein said fixed slider comprises a button which is slideable in a longitudinal slot of the rod, said button being supported at the end of an arm, said arm having an angular position which is adjustable.

3. Device according to claim 1, wherein said angular spacing means comprises a fluid-driven piston.

4. Device according to claim 1, wherein screw-adjustable approach and spacing stroke limiters are mounted between said unit and said frame.

* * * * *